US010056207B2

(12) United States Patent
Wareham et al.

(10) Patent No.: US 10,056,207 B2
(45) Date of Patent: Aug. 21, 2018

(54) KEYPAD WITH REPLACEABLE KEY LABELS

(71) Applicant: DynaGen Technologies, Inc., Dartmouth (CA)

(72) Inventors: Paul Wareham, Bedford (CA); Richard Robert Coulson, Markham (CA); Wesley Warren Manning, Eastern Passage (CA); Sean Nutter, Enfield (CA)

(73) Assignee: DYNAGEN TECHNOLOGIES, INC., Dartmouth (CA)

( * ) Notice: Subject to any disclaimer, the term of this patent is extended or adjusted under 35 U.S.C. 154(b) by 0 days.

(21) Appl. No.: 15/478,329

(22) Filed: Apr. 4, 2017

(65) Prior Publication Data

US 2017/0294279 A1 Oct. 12, 2017

Related U.S. Application Data

(60) Provisional application No. 62/318,900, filed on Apr. 6, 2016.

(51) Int. Cl.

| | |
|---|---|
| ***H01H 9/26*** | (2006.01) |
| ***H01H 13/72*** | (2006.01) |
| ***H01H 13/76*** | (2006.01) |
| ***H01H 13/83*** | (2006.01) |
| ***H01H 13/705*** | (2006.01) |

(52) U.S. Cl.
CPC ..... *H01H 13/83* (2013.01); *H01H 13/705* (2013.01); *H01H 2219/002* (2013.01)

(58) Field of Classification Search
CPC ..... H01H 13/83; H01H 13/705; H01H 2219/002; H01H 3/00; H01H 3/02; H01H 3/12; H01H 2003/12; H01H 2221/00; H01H 2221/002; H01H 2221/048; H01H 2221/054; H01H 35/2621; H01H 35/00; H01H 36/00; H01H 2233/07; H01H 2233/074; H01H 2233/086; H01H 13/00; H01H 13/04; H01H 13/06; H01H 13/063; H01H 13/10; H01H 13/14; H01H 13/50; H01H 13/52; H01H 13/70; H01H 13/7013; H01H 13/7006
USPC ..... 200/5 A
See application file for complete search history.

(56) References Cited

U.S. PATENT DOCUMENTS

| | | | | |
|---|---|---|---|---|
| 4,096,364 | A | 6/1978 | Lynn et al. | |
| 4,694,725 | A * | 9/1987 | Seevers | G06F 3/165 341/27 |
| 5,367,133 | A * | 11/1994 | Schmidt | H01H 13/14 200/302.1 |
| 5,612,692 | A | 3/1997 | Dugas et al. | |
| 6,762,381 | B2 | 7/2004 | Kunthady et al. | |
| 7,283,066 | B2 | 10/2007 | Shipman | |

OTHER PUBLICATIONS

Powerkey Pro Product Accessory Catalog.

* cited by examiner

*Primary Examiner* — Anthony R. Jimenez
(74) *Attorney, Agent, or Firm* — ABM Intellectual Property Inc.; Adrienne Bieber McNeil

(57) ABSTRACT

A key able to accept a label for a keypad used in controlling electrically operated devices, wherein the key structure accepts and secures an interchangeable label, and which forms an impermeable barrier to the electrical contacts of a programmable circuit board.

19 Claims, 5 Drawing Sheets

KEYPAD WITH REPLACEABLE KEY LABELS

CROSS REFERENCE TO RELATED APPLICATIONS

This application claims priority to U.S. provisional application Ser. No. 62/318,900 filed Apr. 6, 2016.

BACKGROUND OF THE INVENTION

Field of the Invention

The present invention relates to a keypad for electrically controlling equipment wherein the push button keys have a replaceable label component affixed to the key and where the keypad is completely sealed from environmental hazards.

Background and Related Art

For manufacturers and users of electrical devices operated through a keypad, there is often a problem with making the keypad adaptable to the device with which it interfaces, for example, when switches may be reconfigured or reprogrammed, because the device is being sold to users of a different language, or the application has changed. To make a keypad more adaptable, it would be desirable to have a method of changing the visual cues, such as the color or marking of a label on the individual keys of a keypad. Another problem is that keypads designed to exclude environmental hazards by having a continuous keypad covering, when manufactured using flexible material, may not provide mechanical, tactile, or audible feedback when actuated to make or break a circuit.

U.S. Pat. No. 5,367,133 "Keypad Including Membrane with Replaceable Key Element" is one example of a keypad having changeable key markings; however, this was achieved by removing and replacing the entire button portion of the key making the operation of the switch unusable at that position if lost.

Keypads such as the PowerKey Pro available from Digital Switching Systems LLC, Raleigh, N.C., USA are other examples of re-allocatable keypads for use in heavy duty settings. The PowerKey Pro contains removable button components but if removed, the button becomes inconvenient to use. Further, the attachment method lacks a locking mechanism to prevent accidental removal and loss of a key.

It is desirable to provide a type of button or key member for a keypad that can be useable, durable, and sealed against the environment (water, dust, caustic materials, etc.) but that can have a removable label piece capable of being removed or added easily and that would allow the user to label the button as desired for clarity of purpose.

SUMMARY OF THE INVENTION

The present invention provides a key for housing and addressing a switch element, wherein a key comprises a main piece on one side of a keypad surface protecting membrane and a switch actuating piece on the opposite side of the membrane and where the main piece is formed to accept and to shield a replaceable label component for conveying the function of the key to the operator.

In one embodiment, the present invention provides a keypad on a programmable control panel having a circuit board where the individual keys can have different functionality depending on the application and programming of the control panel. The control panel can be used in heavy duty or hazardous applications where it is desirable for any indicium or text on the key to be easily replaceable and durable and for the keypad to be impermeable and protect the electrical switches within the circuit board. In one embodiment, the present invention provides a keypad for actuating switch elements controlling multiple modes or functions of an electrically operated device, comprising:

- a membrane, having a plurality of shaped keys integral to the membrane, whereby pressing of the key causes flexing of the membrane and actuation of a switch element having a defined function; and where
- a key comprises a main piece on one side of the membrane and a switch actuating piece on the opposite side of the membrane and where the main piece is formed to accept and to shield a replaceable label component for conveying the function of the key to the operator.

In another aspect of the invention, a kit containing interchangeable label pieces compatible with a key piece of the invention is provided. In one aspect, the kit comprises a keypad with one or more key pieces and compatible label pieces able to be secured to the key piece and being replaceable by the user, the kit further comprising written instructions for the method of changing and, optionally, marking the label pieces.

DESCRIPTION OF THE FIGURES

FIG. 56 shows magnet 51 affixed to the label piece and held by flange 53 thereon and the magnet receiving space 54 within key piece.

DETAILED DESCRIPTION OF THE INVENTION

In order that the present invention may be more readily understood, certain terms are first defined. Additional definitions are set forth throughout the detailed description.

All publications, including but not limited to patents and patent applications, cited in this specification are herein incorporated by reference as though fully set forth.

Definitions

A "marking" or "indicium" may be text, a letter, abbreviation, or a symbol (such as an arrow) that cues the user of the key or keypad as to the function controlled by the underlying switch.

The term "switches" means a single point of mechanically operable electrical connection (or interruption).

A "key" (also known as a button) is located on a control panel face (the "keypad") that is accessible to the user and to environmental conditions. The keys and keypad area are sealed. The key may be partially or fully translucent such that backlighting provides a means for enhancing the recognizability of the location or function of the key. The key will have a label portion which may further be marked by an opaque or semi-opaque symbol or some other indicium, alternatively or in addition, the label portion of the key may have a raised feature to indicate the function. A visible indicium such as text, a symbol, or a color marks the key such that the user is advised of the key's function or purpose. A raised feature, such as, but not limited to a pattern of dots or ridges, may provide a means by with the function of the key can be detected tactilely. The main key piece seals and protects the switches and also serves to provide a suitable surface for the user to push against for user comfort and convenience. In an embodiment, the main key piece material is continuous with an elastomeric membrane covering the keypad, which when positioned within the keypad housing, provides protection against environmental or mechanical damage to the electrical components of the keypad and underlying circuits.

The invention improves on the prior art with the following:

1. Only a small portion of the key, designated the label piece, is removable allowing the key to maintain position and functionality even in the absence of the label piece. This is important for critical applications that require use of the key.
2. The key label piece is secured to the key. In one embodiment, the method of securing the label piece to the key is with a barbed locking mechanism that securely locks the label piece to the main piece. Further provided are features for aligning or orienting the label on the main piece of the key such as an alignment hole.
3. The label piece is guarded on all sides by the main key piece such that no accidental force (e.g. rubbing or brushing action) can accidently remove the key.

Figure 1:
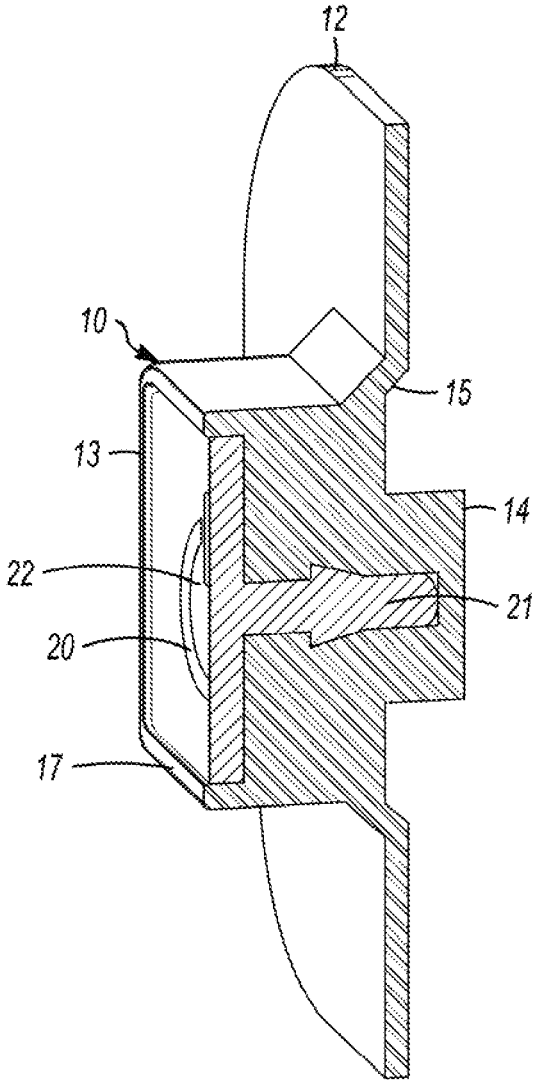
FIG. 1 is a drawing of a cross section of a key according to the invention showing an example of a label piece being secured to the key with a barbed retainment post (21).

An example of a key comprising the keypad of the invention is shown in FIG. 1. The keypad would consist of one or a plurality of keys such as the one shown in FIG. 1, where each key 10 is sealed to and continuous with an impermeable, elastomeric membrane 12, and has a main piece 13 emerging from the plane of the membrane 12 on one side of the membrane and has a switch actuating piece 14 extending from the plane of the membrane opposite the main piece. In the region immediate adjacent to the main key piece 13, the thickness of the material of membrane 12 may be thinner to allow movement of the main key piece (i.e. the key press and release movement). The seal 15 between the key and the membrane may be of a thickness to provide stability to the key.

In one embodiment of the method of operating the invention, the user actuates the tactile switch indirectly by depressing the main piece 13 which is made of flexible material, applying enough force to the key so that the switch actuating piece 14 actuates the tactile key mounted to the circuit board where the tactile key, once contact has been made, has the ability to snap or spring back providing both a mechanical (tactile) and audible (click) feedback signal to the user.

Figure 2:
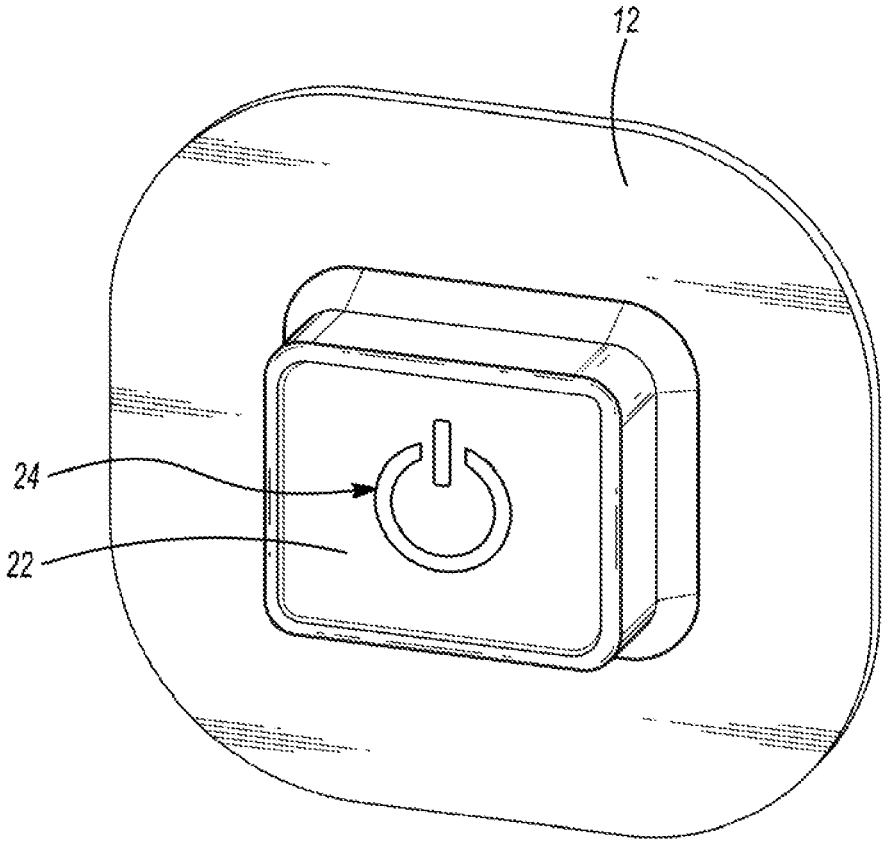
FIG. 2 is a drawing of a top view of a key according to the invention showing a translucent label piece having an opaque symbol therein (24).

In an embodiment, the user is cued to the individual functions of the switches of the keypad by a label piece 20 affixed to the main piece where the label piece, when secured to the main piece, has only the one visible and contactable surface 22, being shielded by the protruding sides 17 of the main piece 13. FIG. 2 shows a key with a label piece with an indicum 24 marked nontransparently thereon and affixed to a key. When a key as shown in FIG. 2 has a translucent core, surface 22, maybe illuminated and the indicium 24, being opaque, remains visible.

In order to increase the visibility of the key and its function to the user, in one embodiment, the key may be constructed having a fully translucent or partially translucent inner core 16 (FIG. 3) with the label piece 20 being translucent or partially translucent and, optionally, being colored or having an opaque mark or symbol or other indicium conveying the function of the key to the user. In the case of a keypad comprising translucent or partially translucent keys, the keypad will be backlight. In one aspect, a key with a colored label piece can be partially translucent such that it could mimic an indicator lamp to be used to indicate the status of the underlying switch.

Figure 3:
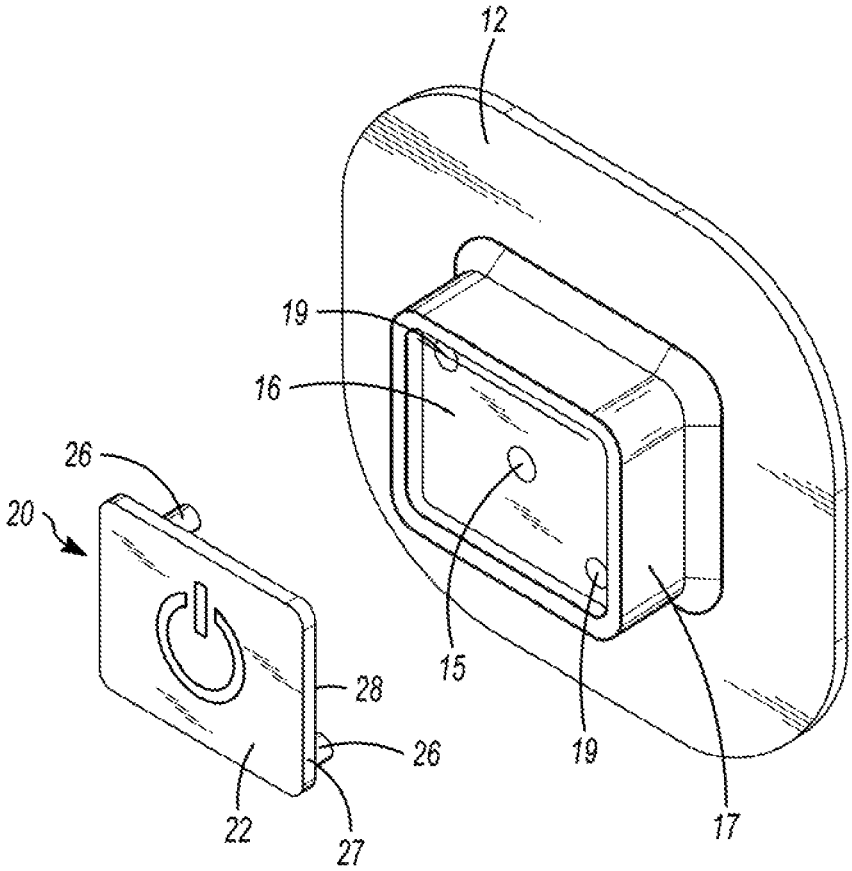
FIG. 3 is a drawing of a key according to the invention showing an example of optional insertion or alignment features on the label and the main piece in a key, such as an insertion hole (15) for accepting a retainment post and alignment holes (19) for insertion of alignment pins (26) on surface (28) of the label piece.

Referring to FIG. 3, label piece 20 is made of a rugged material which is also, optionally, elastomeric and may have a smooth or nonsmooth surface which is substantially a flat surface 22 for contact by the user, sides 27 and, a substantially flat back 28. In one aspect, for better engagement and to prevent slipping, surface 22 of the label piece may be ridged or coated with fine granules, have a slightly raised grid design, or any feature known in the art for preventing slipping once the user intentionally contacts the key. In order to align and, where necessary, orient the label on the main piece of the key, the label piece may have alignment pins 26 or knobs protruding from back surface 28 making contact with the main piece. In another aspect, the label piece may have one or more members projecting outward from side back surface 28 that will be placed within the key main piece, where the projecting feature is intended to engage a cavity such as insertion hole 15 in the key, which cavity may extend from the main piece through the plane of the membrane into the switch actuating piece as depicted in FIGS. 1 and 3. In one embodiment, the projecting member is a barbed retainment post 21 as shown in cross section in FIG. 1, or the retainment post may have multiple barbs that encompass all or a portion of the post. In another aspect, the post has an encircling flange that locks into the key, or has a bulbous end, such as a teardrop shape, where the shape of the post is mirrored by a lip or shaped cavity in the main piece of the key. In one aspect, the retainment post is press fit to the key main piece. In another aspect, the feature projecting from the back surface of the label piece is one or more prongs that may be parallel or inclined towards or away from one another, and may further be smooth, ridged or toothed. In another aspect, the feature projecting from the back surface of the label piece is unitary with the label piece. In further aspect, the feature projecting from the back surface of the label piece is comprised of a different material than the of the label piece and is affixed thereto by fusion, adhesive, or fits within a casing formed in the label piece.

In an embodiment, the label piece is completely encircled and shielded on side surfaces 27 by protruding sides 17 (FIGS. 1 and 3) of the main piece 13 of the key. Together, the contact between ridges, alignment pins, and, optionally, a retainment post allow for the secure and exact positioning of the label piece to the key but also allow the label piece to be removed and replaced as needed due to change in the function of the key to which it is affixed or for another reason such as use by an operator preferring the label have another feature be it the indicator symbol, text, color or the like.

Figure 4:
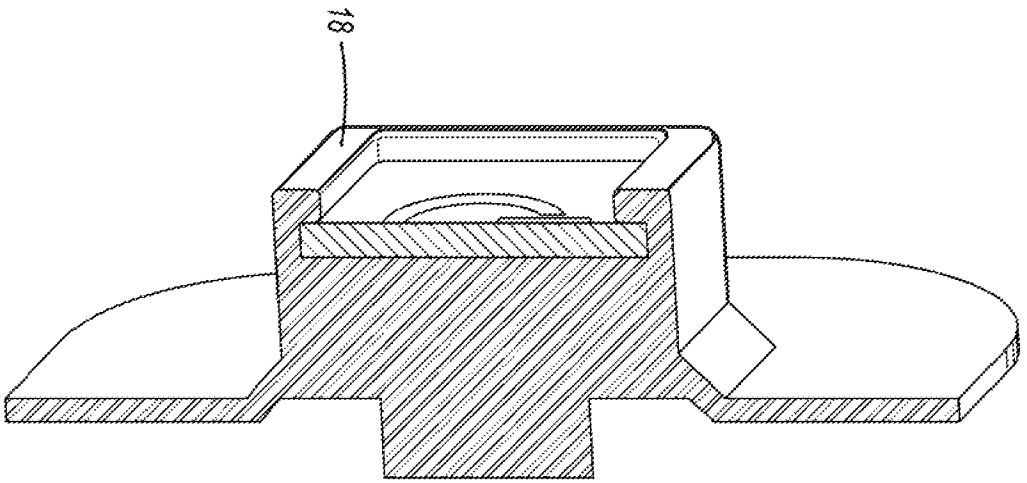
FIG. 4 is a drawing of a key according to the invention showing an example of key wherein the sides of the main piece form a flange (18) capable of overlapping the contact surface of the label piece.
Figure 5A:
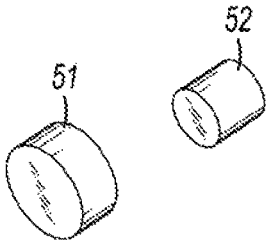
FIG. 5A shows polarly oriented magnets 51 and 52.
Figure 5B:
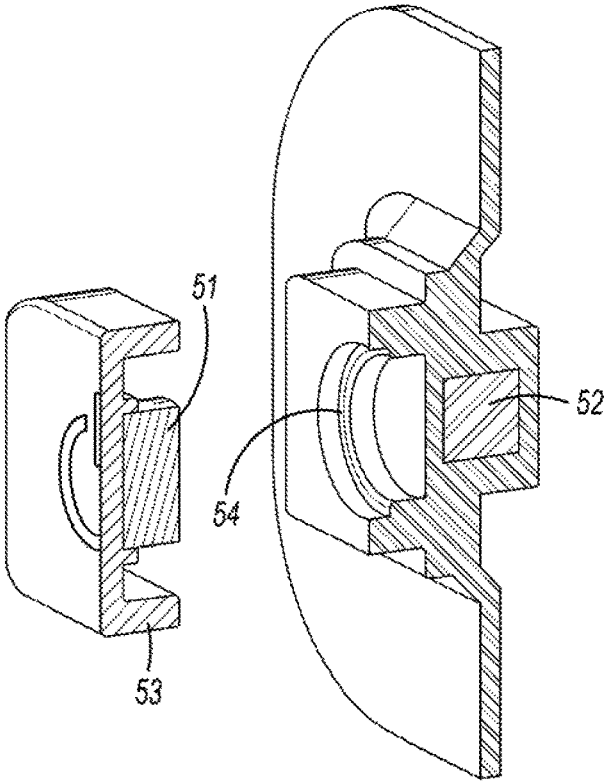
FIG. 5C shows the label piece attracted to magnet 52 embedded in the base of the key.
Figure 5C:
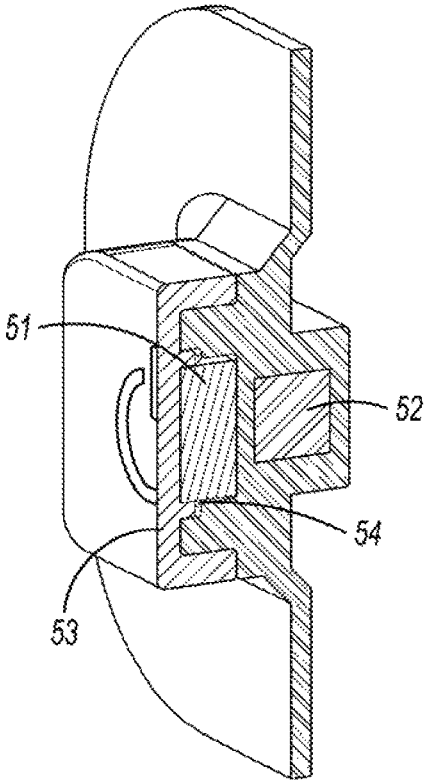

In another embodiment, the label piece is secured to the main piece by flanges 18 that overlap the label piece formed by elevated side surfaces that overlap a portion of the surface of the label piece (FIG. 4). In another embodiment as shown in FIG. 5, the label piece comprises a flange 53 that protrudes into the main piece of the key at an accommodating space 54 that is of a diameter to encompass a small magnet 51, the key portion having embedded within it, a second magnet 52 whereby both magnets are oriented such that the opposite polarity of the two magnets encourages and secures contact between the label piece and the main piece of the key as shown in FIG. 5A-C. In one aspect, the magnets are strong permanent magnets, such as, but not limited to, those composed of an alloy containing a rare-earth element, especially neodymium and samarium-cobalt.

It is further noted, that the design of the main piece of the key and, when present, the seal with the keypad surface covering membrane form an impermeable barrier between keypad and the underlying electrical contacts with or without the presence of the label piece. Therefore, the operation of the device or equipment in the absence of one or more labels of the keypad is not compromised.

The membrane and the keys and the label component can be constructed or formed from any suitable material known in the art providing that the material is capable of forming a continuous and impermeable barrier that will protect electrical switches from unwanted electrical conduction or failure otherwise. In one embodiment, the membrane is made of black silicone and the keys are placed through and sealed to the black silicone.

In an embodiment, there is provided a key or keys with a label piece or indicium capable of illumination. An example of a keypad comprising keys of the present invention is one with a light channeling membrane and preferably key members constructed at least partially of translucent material so that light produced from a light source is channeled upwardly to the upper surfaces of the key members. The light source may include LED (light emitting diode) or LEC (light-emitting electrochemical cell) or LCD (liquid crystal display) systems in adjoining relationship to the light channeling membrane or a light pipe. In an embodiment, the light source is a substantially planar luminescent sheet which underlies the light channeling membrane. In an alternate embodiment, the source of illumination may be a light pipe constructed to illuminate light laterally along a portion of its length to illuminate a plurality of key members.

Methods of Using the Invention

The key or keys of the present invention are useful as an array or keypad interfacing with a printed circuit board in an electrical device. In one embodiment, each key of the keypad is of a minimum size and depth and comprised of such a material as to be able to engage the switch elements while accommodating the label piece and key piece elements required to engage and secure the label piece such as a barb or alignment elements. In another embodiment, the keypad is used in a sealed heavy duty control panel. In one aspect, the control panel is used to operate heavy duty equipment in a manufacturing plant, such as equipment capable of repeated movements. In another embodiment, the keypad is used in a setting where the operator repeatedly uses fluids incompatible with electrical switches, such a technician involved in operating imaging equipment after applying electrically conductive fluids or gels to a patient. It is understood that the above embodiments are given for illustrative purposes and in no way are to be construed as limiting the possible applications of the present inventions disclosed herein.

In one embodiment, the keypad interfaces with a printed circuit board having a plurality of dual channel switch sites thereon. The keys of the keypad may actuate the switch at the switch site either by directly making a conductive contact or making conductive contact by transferring force to a conductive element. One example of manner in which a key on the keypad may make indirect contact is as described in U.S. Pat. No. 5,612,692; by interacting with dome-shaped conductive resilient elements generally called domes that act cooperatively with the keys, which in their relaxed state maintain the switch open, and in their depressed and tripped state close the switch. The domes provide a point of engagement by an actuator or key which in turn engages contacts on the switch site.

In another aspect of the invention, a kit comprising one or more key elements formed to accept and retain a label piece is assembled wherein the kit further comprises one or more label pieces compatible for use with the particular key shape in the kit. In one embodiment, the kit contains key pieces and an equal or greater number of insertable label pieces which are premarked according to functions routinely controlled by a keypad. Exemplary, but nonlimiting functions for which label pieces could be marked are: AUTO, RUN, OFF, RPM UP, RPM DOWN, and LOAD/UNLOAD. It will be understood that in many cases, instead of text based markings universal symbols or any marking preferred by the operator may be used to designate functions marked on the label pieces.

While having described the invention in general terms, the embodiments of the invention will be further disclosed in the following examples. The selection and application of certain configurations, materials, and uses of the present invention are not limited to the examples presented herein.

Example 1: Keypad with Flexible Keys and Tactile Switch Interface

A key is mounted to the circuit board or other suitable surface, and has a main key piece which is flexible enough to trigger the tactile key when pushed by the user and rigid enough to spring back to the pre-depressed shape when the underlyng tactile switch is released by the user. The keypad consists of keys such as the one shown in FIG. 1, where each key 10 is sealed to and continuous with an impermeable, elastomeric membrane 12, and has a main piece 13 emerging from the plane membrane 12 on one side of the membrane and has a switch actuating piece 14 extending from the plane of the membrane opposite the main piece. In the region immediately adjacent to the main key piece 13, the thickness of the material of membrane 12 may be thinner to allow movement of the main key piece (i.e. the key press and release movement). The silicon keypad (12) is about 2 to 2.5 mm in thickness at maximum thickness and 1 to 1.2 mm at minimum thickness. It is made of silicon rubber shore 50 A. The button portion of the keypad (17) projects from the flat main portion of keypad (12) about 4 to 5 mm. The seal (15) between the key and the membrane may be of thickness to provide stability to the key.

The user actuates the tactile switch indirectly by depressing the main piece 13 which is made of flexible material, applying enough force to the key so that the switch actuating piece actuates the tactile key mounted to the circuit board where the underlying tactile switch, once contact has been made, has the ability to snap or spring back providing both a mechanical (tactile) and audible (click) feedback signal to the user.

Example 2: Label Piece Having a Barbed Retainment Post

In order to secure the label portion to the key, the label piece may be formed so that an element protrudes from the surface opposite the contact surface. The contact surface is marked so that the operator will contact a key when the indicated function related to the switch function marked is needed. FIG. 1 illustrates a key having a label with a barbed retainment post for insertion and retainment in the key. Label piece (20) with retainment post (21) extension is made of elexan PC (poly carbonate) glossy material where the flat key contact surface (22) is about 1.5 to 2 mm thick. The total height of the label piece from the key surface (22) to the retainment post tip is about 10 mm and the key is 12 mm high by 15 mm wide. The barb is about 3.5 mm in diameter at its thickest and tapers out at 2 mm in diameter and tapers out over a length of about 3 mm and maintains 2 mm diameter for another 2 mm before ending.

As shown in FIG. 3, the label piece may further have alignment pins (26) which are each 7 mm from the center of barb (21), project 2 mm out from back of key surface (22) and are 2 mm in diameter. The sides (28) of the label piece contact surface (22) fit within the raised ridges of the sides (17) of the main key piece and the alignment pins of the label piece insert into insertion holes (19) in the main key piece where label undersurface (28) makes contact.

Example 3: Translucent Key Configuration

The user is cued to the individual functions of the switches of the keypad by a label pieces affixed to the main piece of each key, where the label piece, when secured to the main piece, has only the one visible and contactable surface, being shielded by the protruding sides of the main piece and both the label piece and the core of the key are made of translucent material making it possible for the surface to be illuminated and the black opaque symbols imprinted with the translucent label material to be readily visible.

We claim:

1. A key for actuation of a switch element on a keypad, the switch element having a defined function, wherein the key comprises a main piece on one side of a keypad surface protecting membrane and a switch actuating piece on an opposite side of the membrane, wherein the main piece is formed to accept and to shield a replaceable label component for conveying the function of the key to the operator, and wherein the label component has a first magnet affixed thereto and the main piece has a second magnet affixed within the main piece, whereby the first magnet and the second magnet are polarly oriented to attract the label component to the main piece of the key.

2. The key of claim 1, wherein the label component has label component sides, and the main piece of the key has shaped ridges that encircle and shield the label component sides.

3. The key of claim 1, wherein the main piece of the key has main piece sides and the main piece sides encircle and partially overlap a contact surface of the label component.

4. The key of claim 1, wherein the main piece of the key has an inner core which is comprised of translucent material and the label component is comprised of translucent material or semitranslucent material and a nontranslucent indicium.

5. The key of claim 1, wherein the switch actuating piece has a conductive portion opposite the main piece of the key, and pressing the key causes contact between the conductive portion and the switch element.

6. The key of claim 1, wherein the label component comprises a protruding element such that the protruding element may be inserted in a cavity in the main piece.

7. The key of claim 6, wherein the protruding element of the label component serves to properly align and orient the label component as to its function while allowing the label component to be mechanically removed and replaced in the key.

8. The key of claim 6, wherein the protruding element of the label component is a barbed post.

9. A keypad for actuating switch elements controlling multiple modes or functions of an electrically operated device, comprising:

a membrane and a plurality of shaped keys integral to the membrane, whereby pressing the keys causes flexing of the membrane and actuation of switch elements having respective defined functions; and wherein each key comprises, respectively, a main piece on one side of the membrane and a switch actuating piece on an opposite side of the membrane, wherein each main piece is formed to accept and to shield a replaceable label component for conveying the function of the key to the operator, and wherein each label component has a respective first magnet affixed thereto and each main piece has a respective second magnet affixed within the main piece, whereby the first magnets and the second magnets are polarly oriented to attract the label components to the main pieces of the keys.

10. The keypad of claim 9, wherein the membrane is more flexible in an area immediately adjacent to the keys.

11. The keypad of claim 9, wherein the label components each have label component sides, and the main piece of each key has shaped ridges that encircle and shield the label component sides.

12. The keypad of claim 9, wherein the main piece of each key has main piece sides projecting from the membrane, wherein an edge of the main piece side not connected to the membrane encircles and partially overlaps a contact surface of the label component.

13. The keypad of claim 9, wherein the main piece of each key has an inner core which is comprised of translucent material and the label components are comprised of translucent material or semitranslucent material and a nontranslucent indicium.

14. The keypad of claim 9, wherein the membrane and the integral keys provides a water resistant barrier between the switch elements and the environment.

15. The keypad of claim 9, wherein the label components each comprise a protruding element such that the protruding elements may be inserted in a cavity in the main pieces.

16. The keypad of claim 15, wherein the protruding elements of the label components serve to properly align and orient the label components as to their function while allowing the label components to be mechanically removed and replaced in the keys.

17. The keypad of claim 15, wherein each protruding element of the label components is a barbed post.

18. The keypad of claim 9, wherein each key has a switch actuating portion on the side of the membrane opposite the main piece of the key, and each switch actuating portion has a conductive portion, and pressing the keys causes contact between the conductive portions and the switch elements.

19. The keypad of claim 18, wherein an audible signal is produced by pressing the keys.

* * * * *